US009707673B2

(12) United States Patent
Yang et al.

(10) Patent No.: US 9,707,673 B2
(45) Date of Patent: Jul. 18, 2017

(54) PALM HAMMER

(71) Applicant: TAIZHOU DAJIANG IND. CO., LTD., Wenling (CN)

(72) Inventors: Mingjun Yang, Wenling (CN); Zaijun Zhu, Wenling (CN)

(73) Assignee: TAIZHOU DAIJIANG IND. CO., LTD., Wenling, Zhejiang Province (CN)

( * ) Notice: Subject to any disclaimer, the term of this patent is extended or adjusted under 35 U.S.C. 154(b) by 453 days.

(21) Appl. No.: 14/378,915

(22) PCT Filed: Sep. 30, 2013

(86) PCT No.: PCT/CN2013/084692

§ 371 (c)(1),
(2) Date: Aug. 14, 2014

(87) PCT Pub. No.: WO2014/075519

PCT Pub. Date: May 22, 2014

(65) Prior Publication Data

US 2015/0014390 A1 Jan. 15, 2015

(30) Foreign Application Priority Data

Nov. 15, 2012 (CN) ..... 2012 1 0461846

(51) Int. Cl.
*B25C 1/00* (2006.01)
*B25C 7/00* (2006.01)
*B25C 1/04* (2006.01)

(52) U.S. Cl.
CPC ..... *B25C 1/00* (2013.01); *B25C 1/047* (2013.01); *B25C 7/00* (2013.01)

(58) Field of Classification Search
CPC ..... B25C 1/00; B25C 1/047; B25C 7/00
(Continued)

(56) References Cited

U.S. PATENT DOCUMENTS 3,788,537 A * 1/1974 Fox ..... B25C 1/02 227/142
7,316,342 B2 * 1/2008 Chen ..... B25C 1/04 227/107

(Continued)

FOREIGN PATENT DOCUMENTS

CN 2866018 Y 2/2007
CN 10-1863011 A 10/2010

(Continued)

OTHER PUBLICATIONS

International Search Report in International Application No. PCT/CN2013/079979, filed Jul. 24, 2013.

*Primary Examiner* — Michelle Lopez
(74) *Attorney, Agent, or Firm* — Tim Tingkang Xia, Esq.; Locke Lord LLP

(57) ABSTRACT

A palm hammer comprises a bracket, a hammer body and the guide bushing which comprises a prism-shaped muzzle cover and a muzzle, wherein the muzzle cover and the muzzle are connected through bolts and joined into a body of the guide bushing; the body of the guide bushing may be axially moved in a bracket of the palm hammer; the parts of the muzzle cover and the muzzle near the distal gradually narrow into a chisel-shape; the proximal of the body of the guide bushing rests against a spring on the hammer body of the palm hammer; the body of the guide bushing axially moves in the bracket; a bore used for accommodating a nail and a driving rod is axially opened on the muzzle; one end of a bumper protrudes out of the distal of the body of the guide bushing.

3 Claims, 20 Drawing Sheets

(58) Field of Classification Search
USPC ..... 227/107, 142, 147
See application file for complete search history.

(56) References Cited

U.S. PATENT DOCUMENTS

| | | | | |
|---|---|---|---|---|
| 8,186,554 | B2 * | 5/2012 | Abla | B25C 1/00 227/148 |
| 2007/0199970 | A1 | 8/2007 | Chen | |
| 2010/0084451 | A1 | 4/2010 | Abla | |

FOREIGN PATENT DOCUMENTS

| | | | |
|---|---|---|---|
| CN | 10-3056841 | A | 4/2013 |
| CN | 10-3381588 | A | 11/2013 |

* cited by examiner

PALM HAMMER

CROSS-REFERENCE TO RELATED APPLICATIONS

This application is the U.S. national stage application of International Patent Application No. PCT/CN2013/084692, filed Sep. 30, 2013, which claims priority to Chinese Application No. 201210461846.6, filed Nov. 15, 2012, the disclosures of each of which are incorporated herein by reference in their entirety.

BACKGROUND

Technical Field

The invention relates to a reciprocating, electrically or pneumatically powered impact tool, such as a palm hammer.

A guide bushing of a palm hammer is positioned at the front end of a palm hammer and directly contacts a nail. It needs to rest against a wood board around the nail so as to position the palm hammer. The direction of the nail is generally perpendicular to the wood board. In a narrow corner, the nail may be obliquely hit into the wood board. Currently, the direction of the nail is determined based on the guide bushing's resting against the wood board around it. If the end of the guide bushing cannot extend into the confined space, the palm hammer may not be positioned, and a driving rod of the palm hammer may hit the nail obliquely.

A guide bushing at the head of a palm hammer available is a cylindrical-shaped structure. In practice, the guide bushing may not properly work in small spaces, especially corners, grooves of a floor, etc. U.S. Pat. No. 8,186,554B2 describes a cylindrical-shaped tapered guide bushing. The upper part of the guide bushing is cylindrical and the lower part tapers off into a tip. Therefore, the size of the head of the guide bushing is decreased, allowing for its use in narrow spaces.

However, when the front end of the guide bushing becomes sharpened, the force of the front end on the wood board is greater, not only easily scratching the surface of a floor but also easily wearing out the front end of the guide bushing.

Subsequently, U.S. Pat. No. 8,186,554B2 created a protective device for a work piece, that is, a protective cover for covering the bottom end of a tapered guide bushing. As it covers the bottom end of the taper-shaped body, it effectively increases the size of the tip and hence, reduces its usability in small, confined spaces, such as a groove of a floor, etc.

BRIEF SUMMARY

In order to overcome the aforementioned disadvantages of prior art, the invention provides a palm hammer with a guide bushing which can be conveniently used in narrow spaces and also can protect the working surface of a floor.

A palm hammer of the invention comprises a bracket, a hammer body and the guide bushing, wherein a cylinder end on the bracket and that on the hammer body are movably connected through a pin; the guide bushing is installed into the proximal of the bracket, a spring is fixed inside the bracket; one end of the spring contacts the hammer body, and the other end of the spring contacts the guide bushing, allowing for proper positioning, the spring provides a reset force for the upward and downward movement of the guide bushing;

the hammer body is connected with one end of the bracket through a cylinder and facilitates the bracket to be sleeved at the bottom end of the hammer body, so that the hammer body can be rotated around the axis of the bracket to facilitate the user standing at different angles to use the tool conveniently;

a slot with rectangular cross section and a positioning convex platform are arranged at the inside of the distal of the bracket, the guide bushing is rectangular cross section and accommodated in the slot with rectangular cross section of the bracket, and the two structures with rectangular cross section cooperate to prevent the guide bushing from individually being rotated; the guide bushing moves upwards and downwards along the axial line of the bracket, and is positioned by an axial guide groove of the outer surface of the guide bushing and the positioning convex platform in the inner part of the bracket;

the guide bushing of a palm hammer comprises a prism-shaped muzzle cover and a muzzle, wherein the muzzle cover and the muzzle are connected through bolts and joined into a body of the guide bushing; the body of the guide bushing may be axially moved in a bracket of the palm hammer; the body of the guide bushing has an distal which is far away from the bracket and proximal which is near the bracket; the parts of the muzzle cover and the muzzle near the distal gradually narrow into a chisel-shape; the top side of the proximal of the body is long and narrow plane; the proximal of the body of the guide bushing rests against a spring on the hammer body of the palm hammer; the lateral sides of the muzzle cover and the muzzle respectively have a axial guide groove, a positioning convex platform of the bracket is positioned into the guide groove, thus guaranteeing that the body of the guide bushing axially moves in the bracket and does not break away from the bracket; a bore used for accommodating a nail and a driving rod is axially opened on the muzzle; the bore passes through the distal and proximal of the body of the guide bushing; a positioning groove is opened on the surface of the muzzle opposite to the muzzle cover; one end of a bumper is placed between the muzzle cover and the muzzle through the positioning groove, and the other end of the bumper protrudes out of the distal of the body of the guide bushing; a convex block on the bumper is accommodated into the positioning groove, and the width of the bumper is smaller than that of the distal of the body of the guide bushing.

Furthermore, there are two bumpers.

Furthermore, the bumper is made of material which is not easy to scrape a floor, such as plastic, etc.

As the width of the bumper in the invention is smaller than that of the distal of the body of the guide bushing, when the guide bushing extends outwards and meets a narrow and small corner, the bumper may extend into a smaller corner to position the palm hammer. The protruding part of the bumper directly contacts a work piece, so as to protect the surface of the work piece from being scraped. As the bumper is embedded in the inner part of the guide bushing, the height of the guide bushing does not increase, and the surface of the work piece in a variety of corners may still be protected. Hence, the invention may increase the working performance of the palm hammer in a narrow space. In addition, the bumper may be made of soft materials such as plastic and so on. The bumper, instead of the distal of the body of the guide bushing contacts the floor, which prevents the floor from being scraped and furthermore prevents the distal of the body of the guide bushing from being worn. Although the bumper is easily worn during the working, the guide bushing in the invention is a structure which is easily disassembled, and the bumper is easily replaced.

The invention has the advantages of high performance of being suitable for working in confined spaces, conveniently operating, easily manufacturing and effectively protecting the surface of the work piece from being scraped.

DETAILED DESCRIPTION

Figure 15:
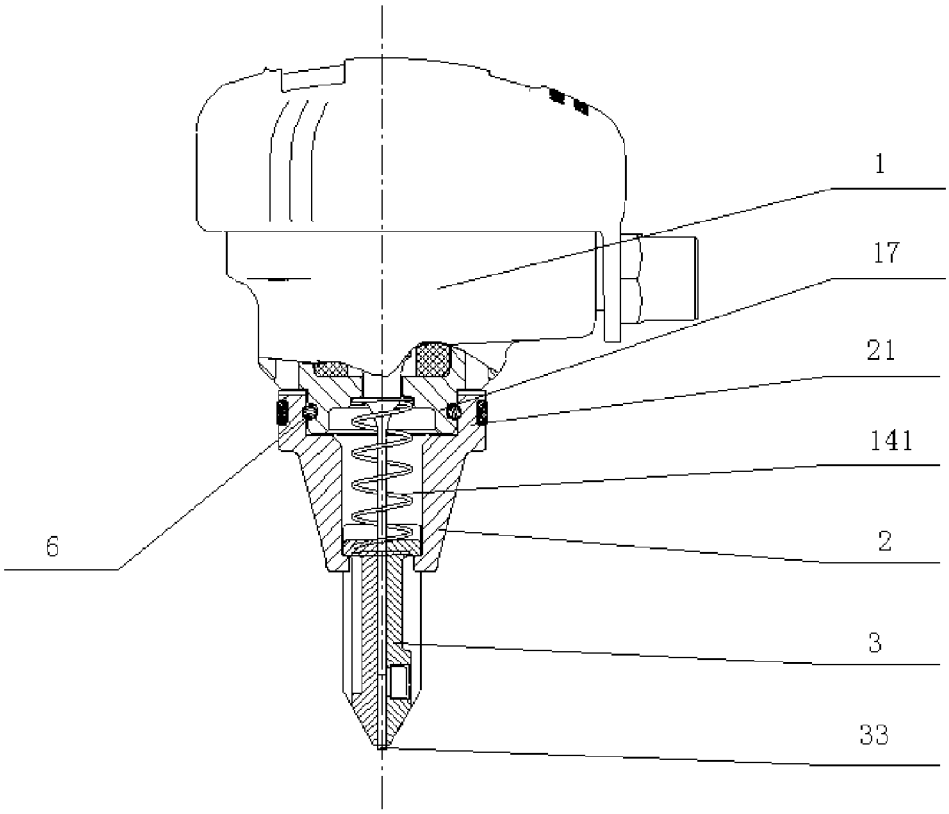
FIG. 15 is a partial sectional view of a palm hammer in the invention.

According to FIG. 15, a palm hammer of the invention comprises a bracket 2, a hammer body 1 and the guide bushing. A cylinder end 21 on the bracket 2 and a cylinder end 17 on the hammer body 1 are movably connected through a pin 6. The guide bushing is installed into the proximal of the bracket 2. A spring 141 is arranged inside the bracket 2. One end of the spring contacts the hammer body 1, and the other end of the spring contacts the guide bushing, allowing for proper positioning. The spring 141 provides a reset force for the upward and downward axial movement of the guide bushing.

The hammer body 1 is connected with one end of the bracket 2 through a cylinder and facilitates the bracket 2 to be sleeved at the bottom end of the hammer body 1, so that the hammer body 1 can be rotated around the axis of the bracket 2 to facilitate the user standing at different angles to use the tool conveniently.

Figure 16:
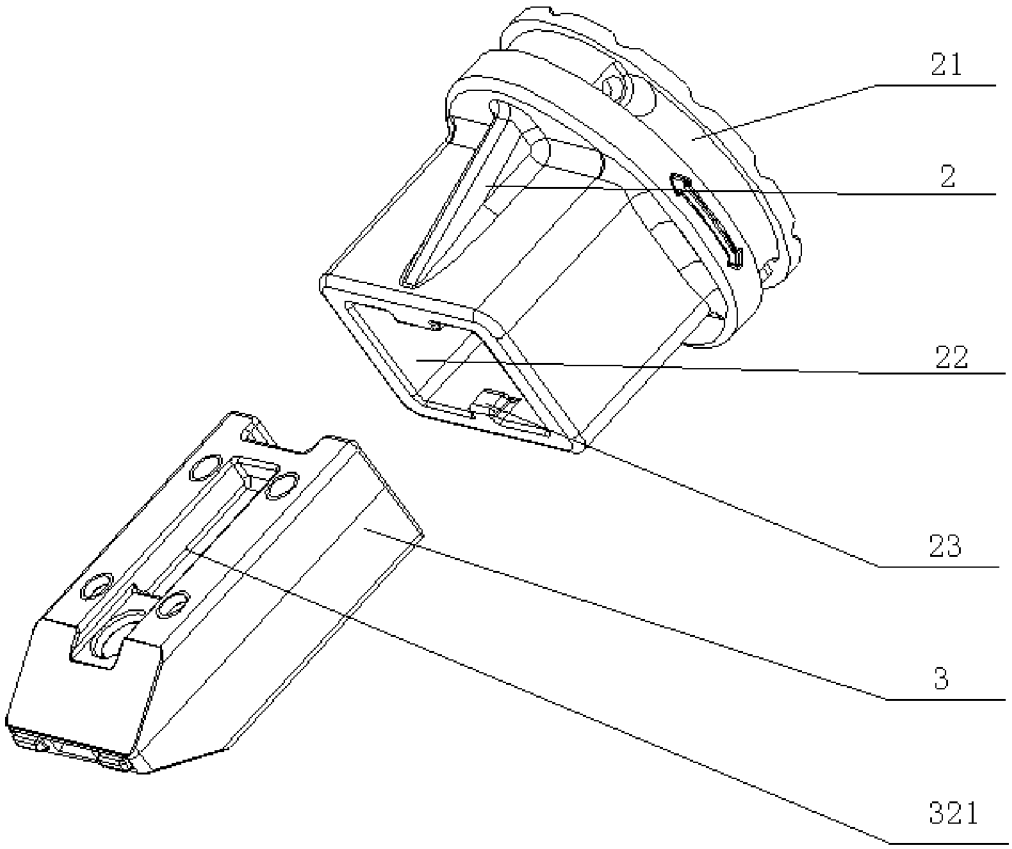
FIG. 16 is a diagram that shows the connection between the bracket and a guide bushing in the invention.
Figure 17:
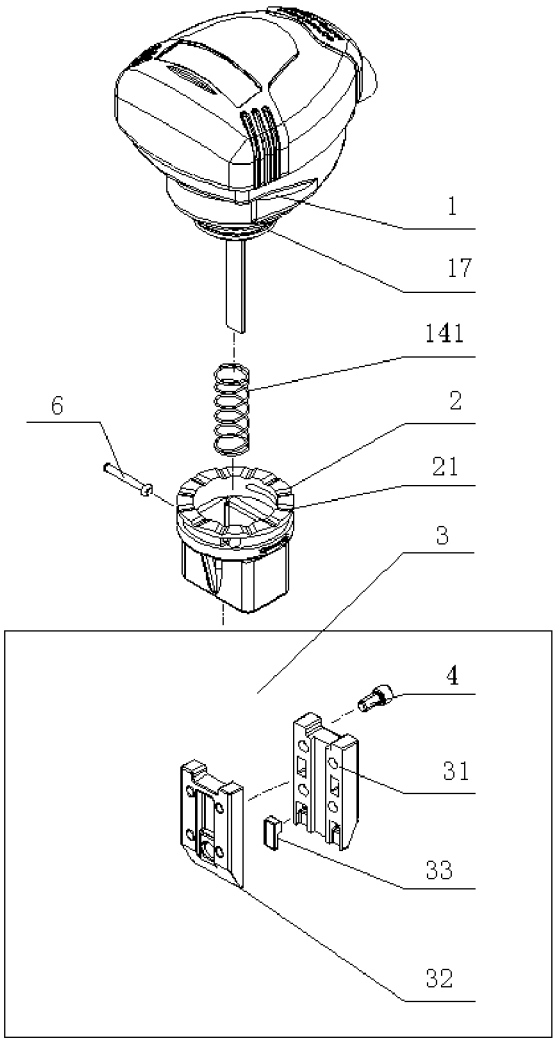
FIG. 17 is an exploded diagram of a part in the invention.

As FIG. 16 shows, the r slot 22 with rectangular cross section and a positioning convex platform 23 are at the inside of the distal of bracket 2. The guide bushing is rectangular cross section and accommodated in the slot 22 of the bracket 2, and the two structures with rectangular cross section cooperate to prevent the guide bushing from individually being rotated. The guide bushing moves upwards and downwards along the axis of the bracket 2 in a slot 22 in the bracket 2, and is positioned through an axial guide groove 321 of the outer surface of the guide bushing and the positioning convex platform 23 in the inner part of the bracket 2.

Refer to FIGS. 1-17, a guide bushing of a palm hammer comprises a prism-shaped muzzle cover 32 and a muzzle 31, wherein the muzzle cover 32 and the muzzle 31 are connected through four bolts 4 and joined into a body 3 of the guide bushing; the body 3 of the guide bushing may be axially moved in a bracket 2 of the palm hammer; the body 3 of the guide bushing has an distal which is far away from the bracket and an proximal which is near the bracket; the parts of the muzzle cover 32 and the muzzle 31 which are close to the distal gradually narrow into chisel-shaped; the top side of the proximal of the body is a long and narrow plane; According to FIG. 5*b*, the proximal of the body rests against spring 141 on a hammer body 1 of the palm hammer; the lateral sides of the muzzle cover 32 and the muzzle 31 respectively have an axial guide groove 321; a positioning convex platform 23 of the bracket 2 is positioned into the guide groove 321, thus guaranteeing that the body 3 of the guide bushing move axially in the bracket 2 and does not break away from the bracket 2; a bore 311 used for accommodating the nail and a driving rod is axially opened on the muzzle 31; the bore 311 passes through the distal and proximal of the body; a positioning groove 312 is opened on the surface of the muzzle 31 opposite to the muzzle cover 32; one end of a bumper 33 is placed between the muzzle cover 32 and muzzle 31 through the positioning groove 312, and the other end of bumper 33 protrudes out of the distal of body 3 of the guide bushing; a convex block 331 on the bumper 33 is accommodated into the positioning groove 312, and the width of the bumper 33 is smaller than that of the distal of the body 3 of the guide bushing.

Furthermore, there are two bumpers 33 affixed to the guide bushing. Furthermore, bumper 33 is made of material that cannot easily damage a floor, such as plastic, rubber, composite materials, etc.

As shown by FIGS. 3*a*, 3*b*, 4*b*, and 4*c*, the guide bushing comprises a muzzle cover 32, a muzzle 31 and a bumper 33, wherein the bore 311 runs through muzzle 31. One end of bore 311 is connected with striker assembly 14 of a hammer body 1, and a nail may be placed in the front part of the bore. The striker assembly 14 contacts the nail and drives it into place. The muzzle cover is connected with the muzzle through a bolt and wraps one end of a bumper to be between the muzzle cover and the muzzle through a limit groove on the surface of the muzzle opposite to the muzzle cover. The other end of the bumper passes out of the outer end of a body of the guide bushing.

As the width of the bumper in the invention is smaller than that of the distal of the body of the guide bushing assembly, when the bushing extends outwards and meets a narrow and small corner, the bumper may extend into a smaller corner and position the palm hammer. The protruding part of the bumper directly contacts the work piece, so as to protect the surface of the work piece from being damaged. As the bumper is embedded in the inner part of the guide bushing, the height of the guide bushing does not increase, and the surface of the work piece in a variety of corners may still be protected. Hence, the invention may increase the working capacity of the palm hammer in a narrow space. In addition, the bumper may be made of soft materials such as plastic, resin, rubber, and other materials. The bumper, instead of the head of the body of the guide bushing, contacts the floor, which prevents the floor from being scraped and prevents the distal of the body of the guide bushing from being worn. Although the bumper is easily worn during the working, the guide bushing in the invention is a structure which is easily disassembled, and the bumper is easily replaced.

Figure 1:
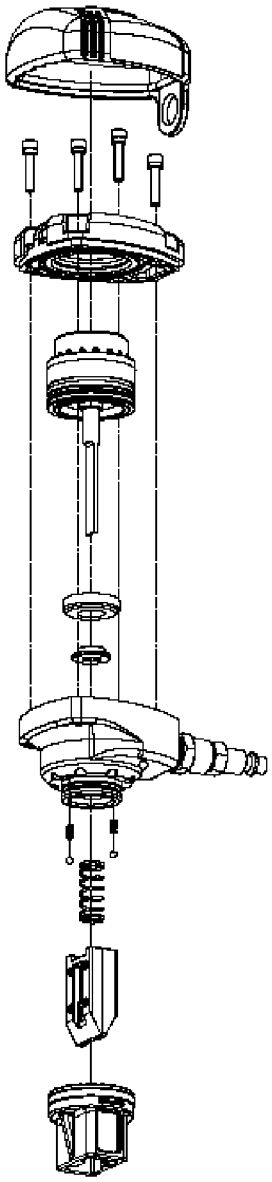
FIG. 1 is a structural diagram of a prism-shaped tapered guide bushing of this invention.
Figure 2:
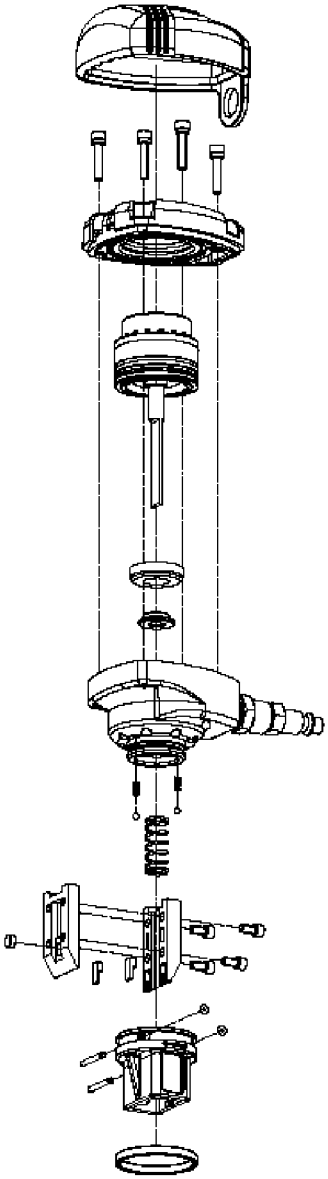
FIG. 2 is a structural diagram of a bumper at the of the tapered body covering the guide bushing of this invention
Figure 3A:
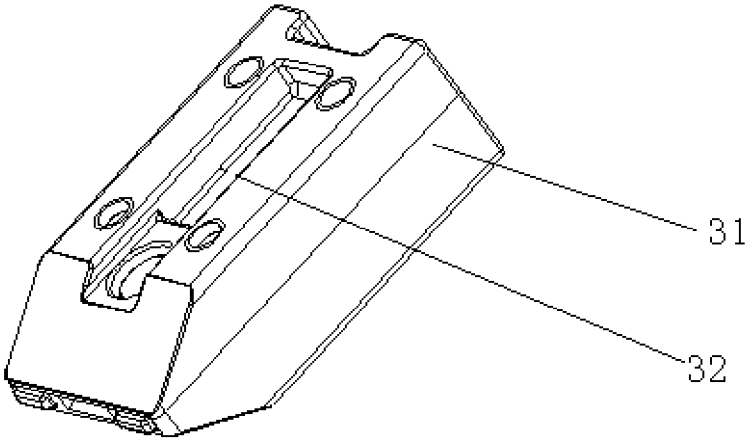
FIG. 3*a* is an overall structural diagram of the guide bushing of a palm hammer in the invention.
Figure 3B:
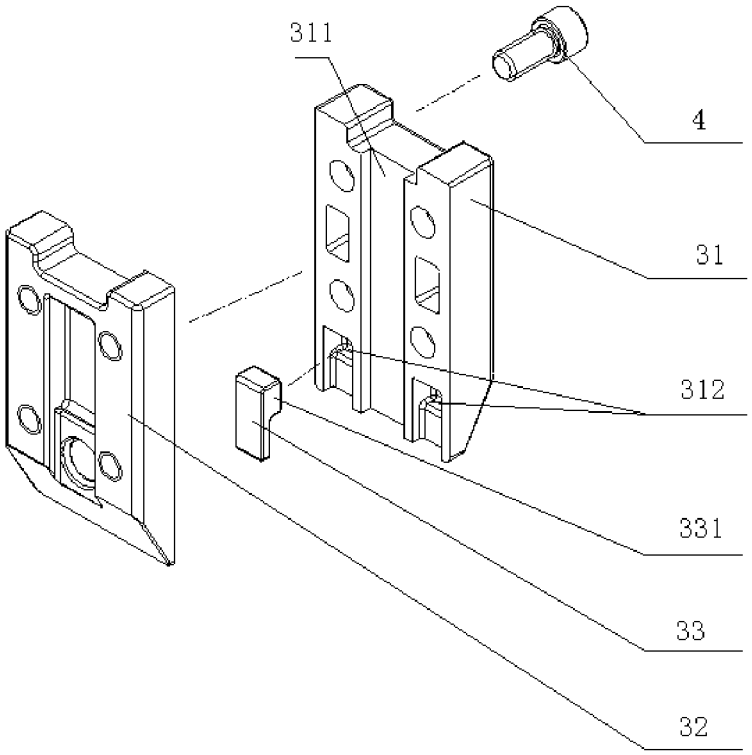
FIG. 3*b* is an exploded diagram of the guide bushing of a palm hammer in the invention.
Figure 4A:
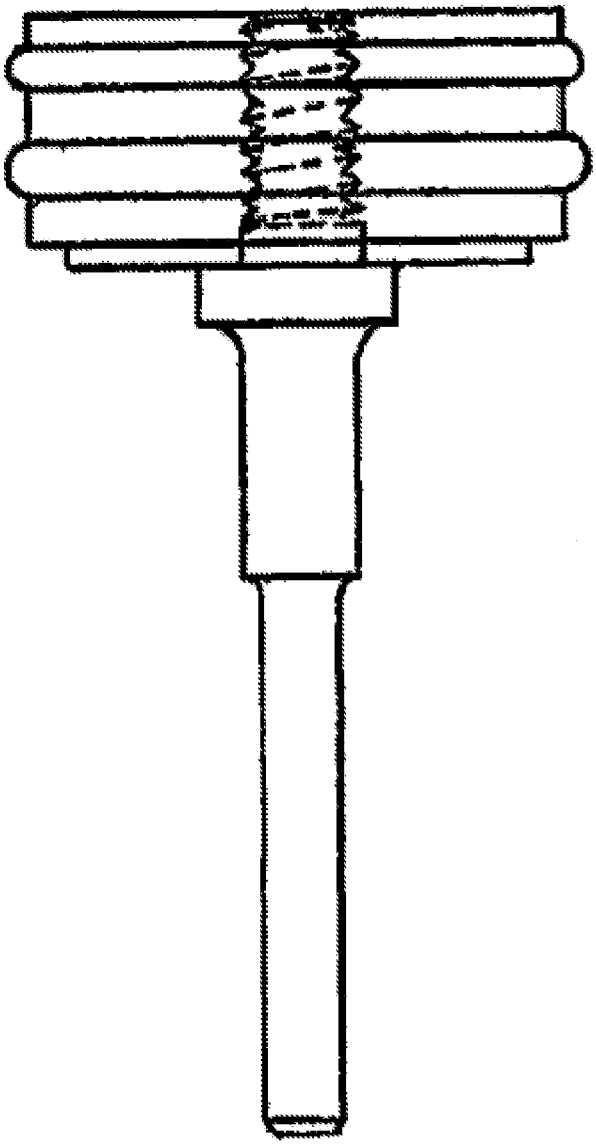
FIG. 4A PRIOR ART
FIG. 4*a* is a structure diagram of the striker assembly in the prior art.
Figure 4B:
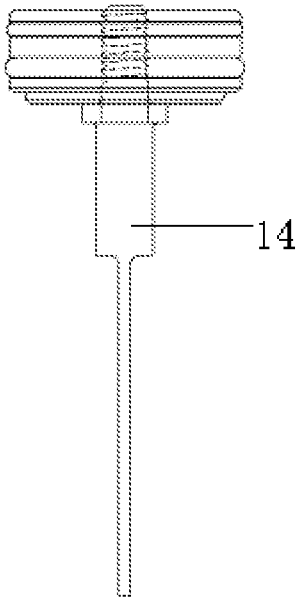
FIG. 4*b* is a structure diagram A of the striker assembly in the invention.
Figure 4C:
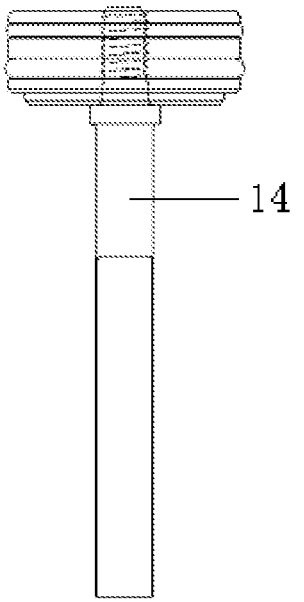
FIG. 4*c* is a structure diagram B of the striker assembly in the invention.
Figure 5A:
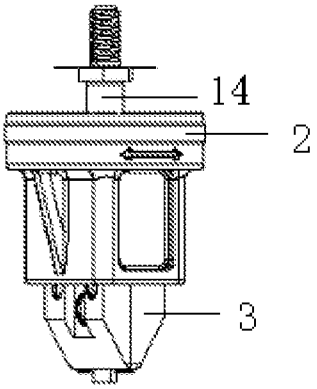
FIG. 5*a* is a cross-sectional diagram of a striker assembly that is matched with a guide bushing and used in the invention.
Figure 5B:
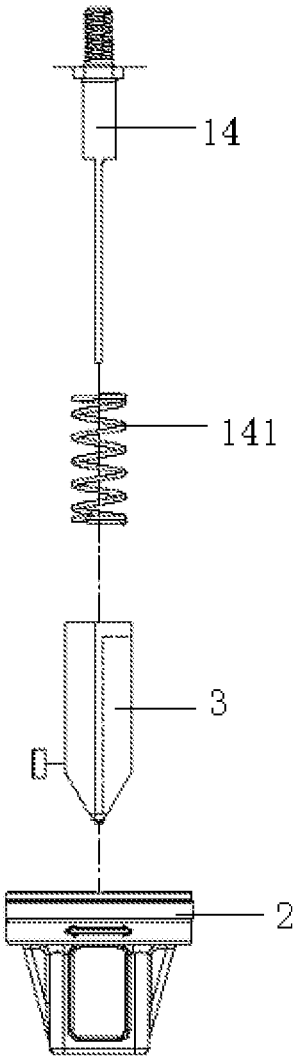
FIG. 5*b* is an exploded diagram of FIG. 5*a*.
Figure 6:
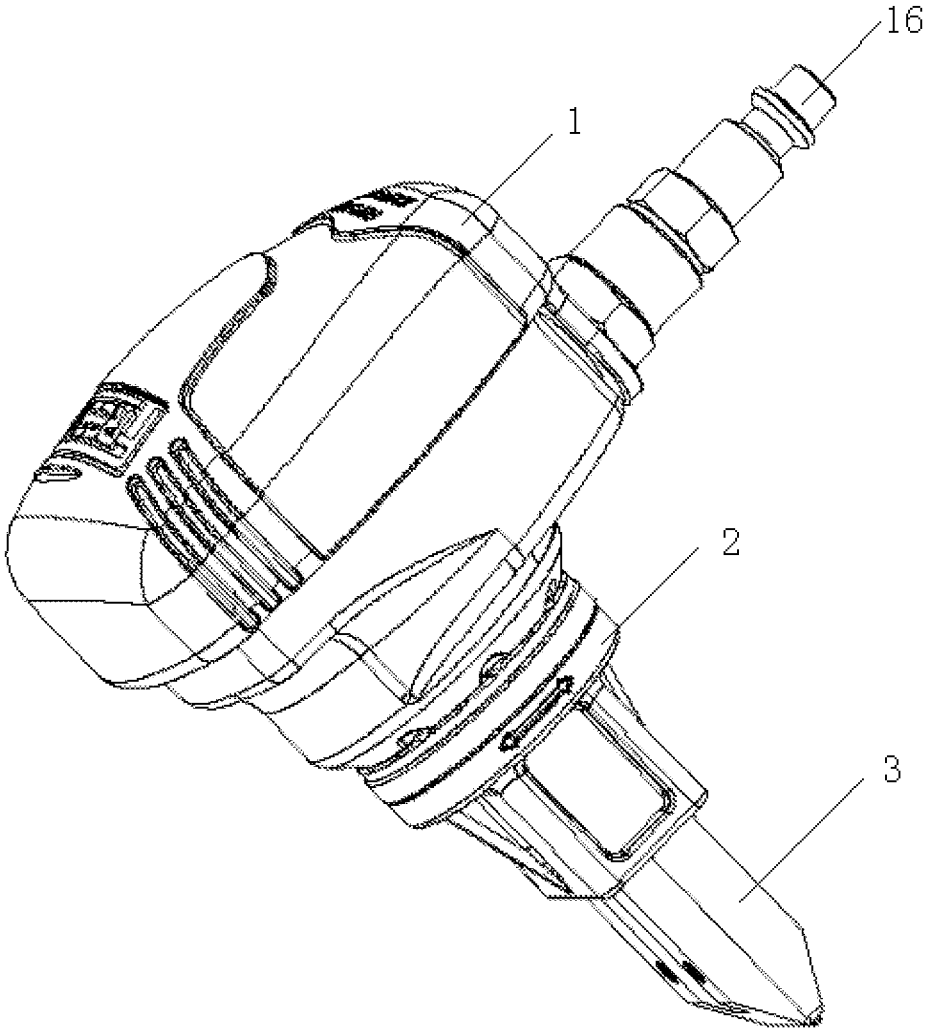
FIG. 6 is an overall structural diagram of a palm hammer in the invention.
Figure 7:
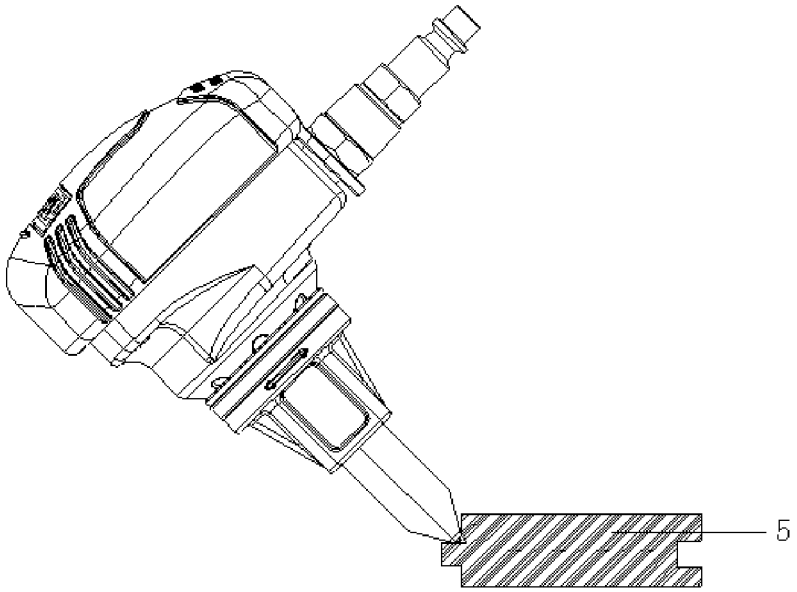
FIG. 7 is a diagram of the invention in use after a corner is rotated.

According to FIGS. 4*a*, 4*b* and 4*c*, as a nail used is a floor nail and the driving rod of the striker assembly in the invention is designed according to the nail; such a design facilitates the nail to be hit stably and reduces the wound area of a floor caused by a driving rod.

Figure 8:
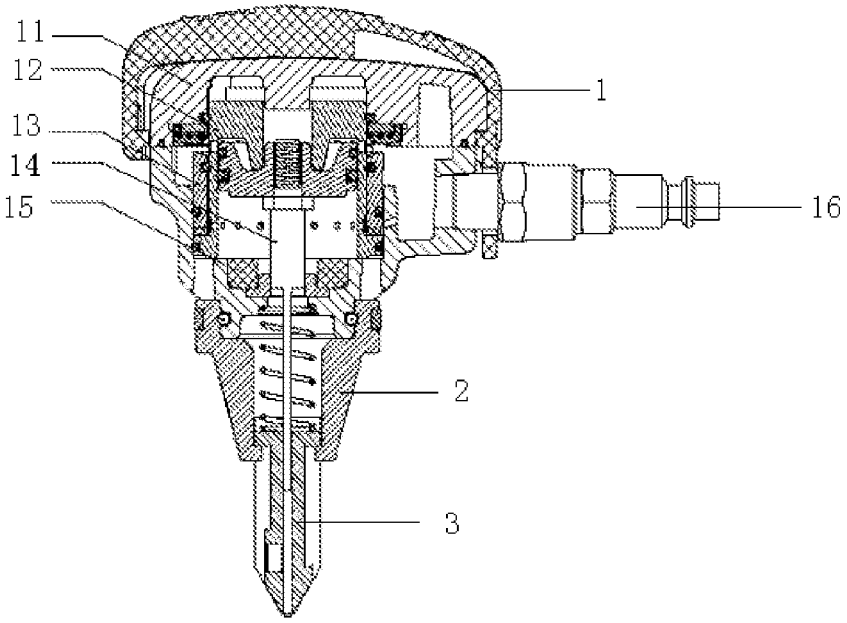
FIG. 8 is a cross-sectional diagram of the invention when a palm hammer is not connected with pressurized air or a power source.
Figure 9:
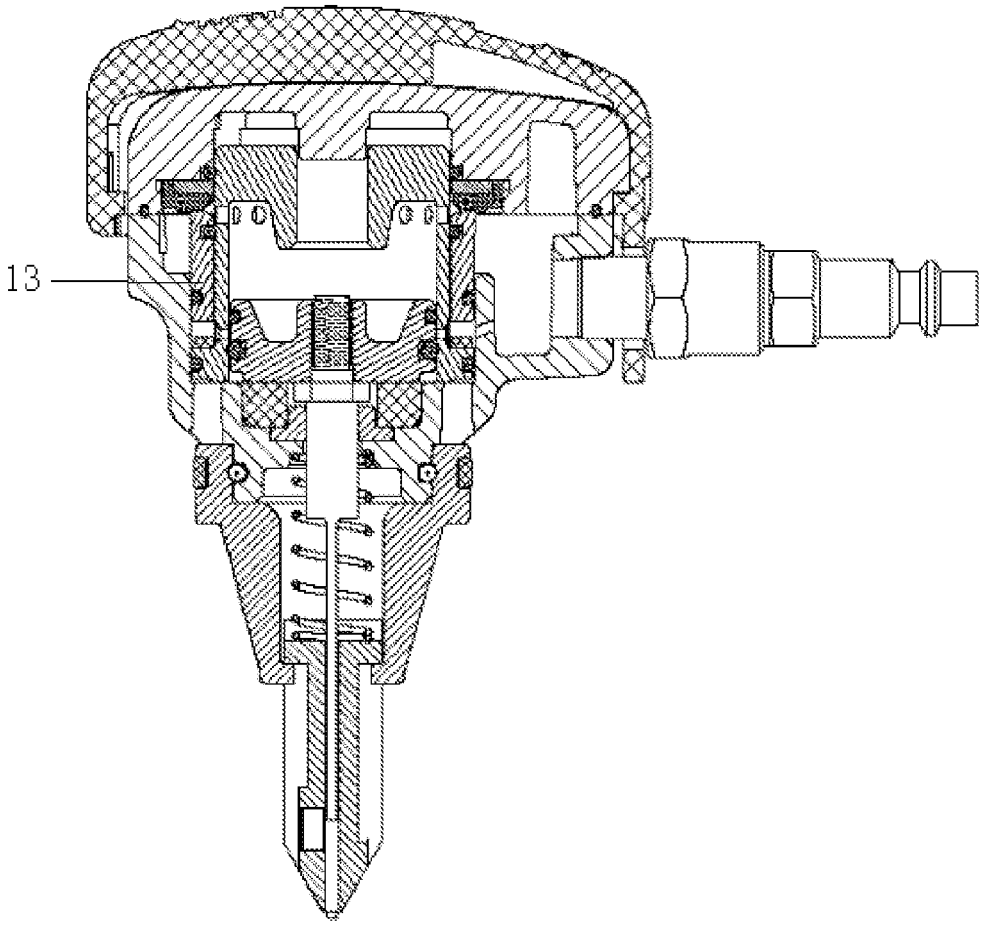
FIG. 9 is a cross-sectional diagram of the invention that shows when a piston and striker rod slides to a designated place after a palm hammer is connected with a pressurized air source
Figure 10:
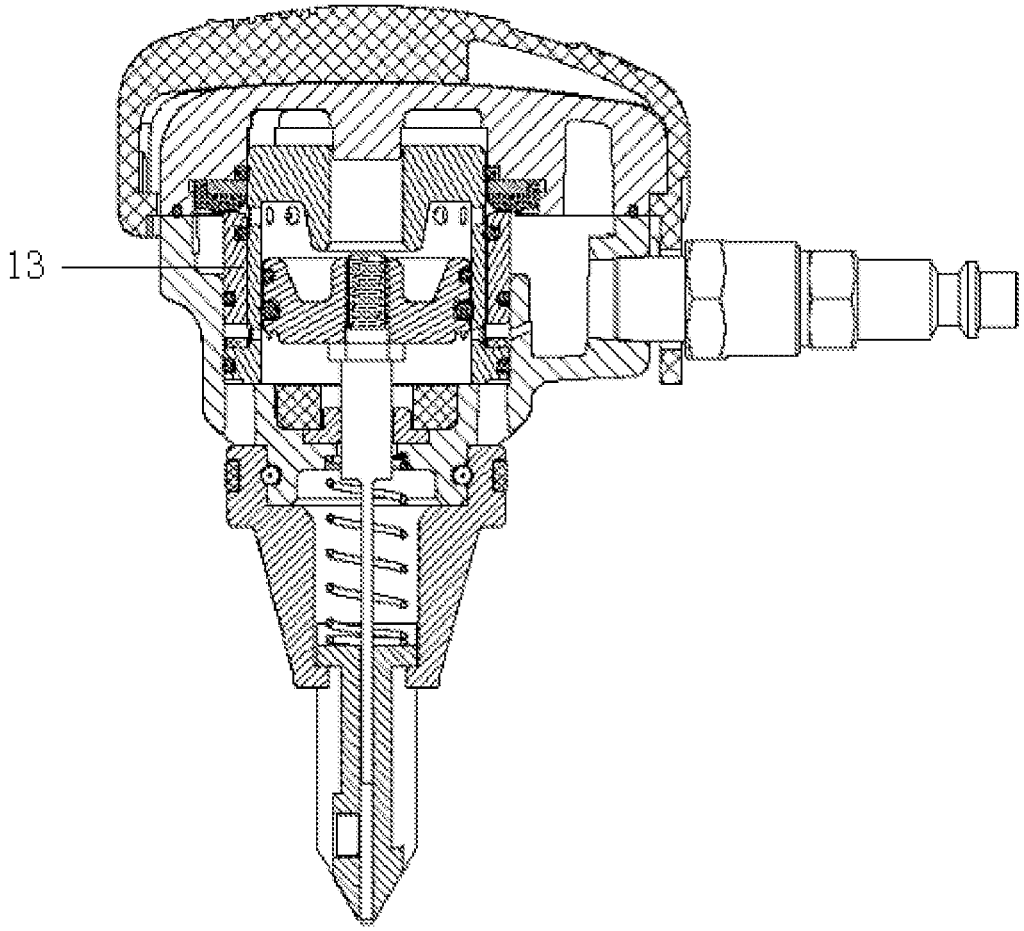
FIG. 10 is a cross-sectional diagram that shows when the striker assembly and driving rod is stressed and slides upwards when a nail is hit in FIG. 9.
Figure 11:
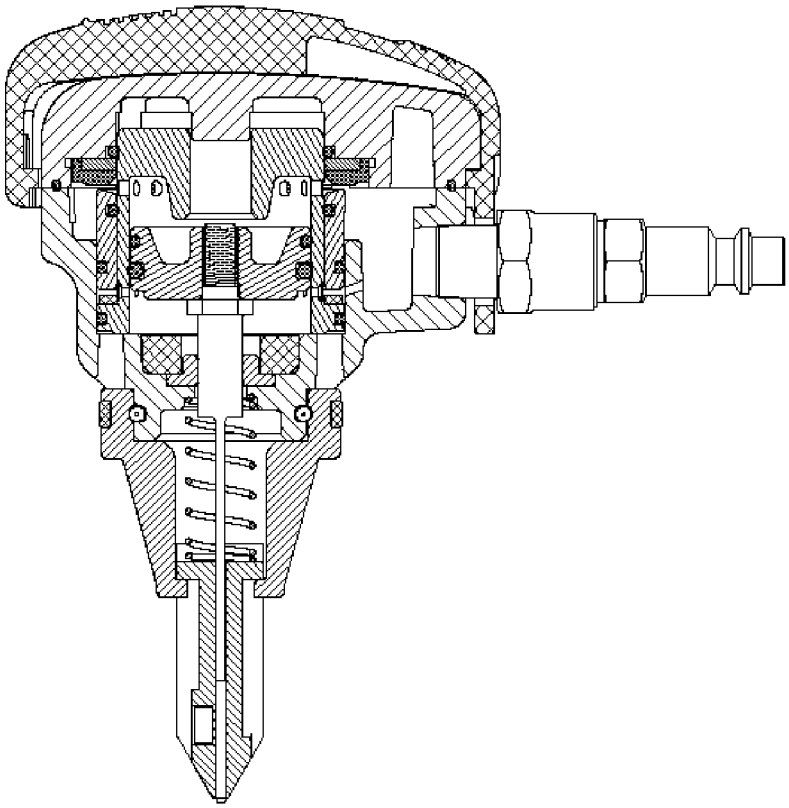
FIG. 11 is a cross-sectional diagram of the invention that shows how compressed air pushes a travelling valve to slide downwards while the striker assembly slides upwards.
Figure 12A:
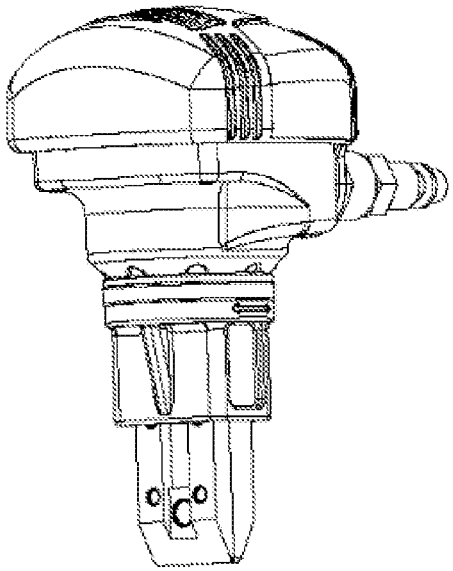
FIG. 12*a* is a diagram of a palm hammer without a bumper.
Figure 12B:
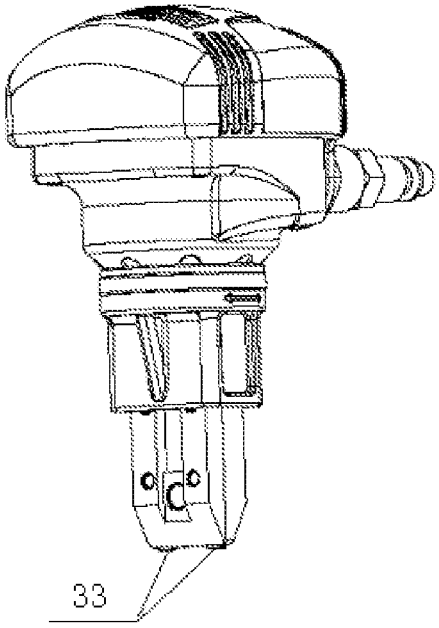
FIG. 12*b* is a diagram of a palm hammer with a bumper.
Figure 13A:
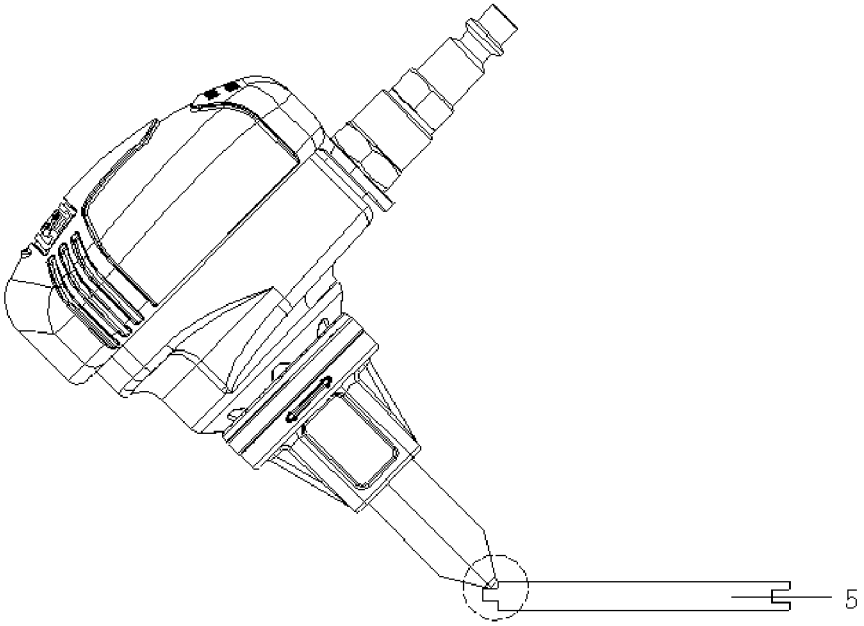
FIG. 13*a* is an diagram of a use state of a palm hammer which is not positioned with a bumper.
Figure 13B:
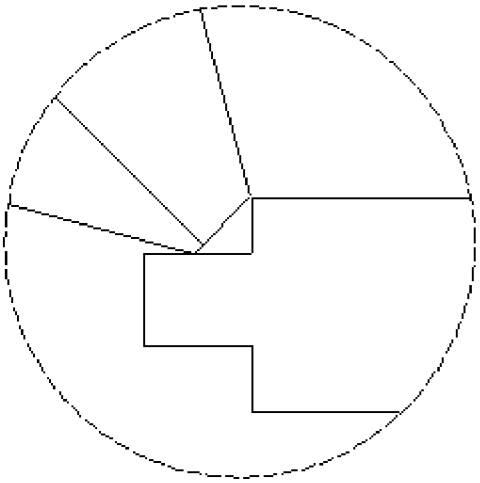
FIG. 13*b* is a partially enlarged diagram of FIG. 13*a*.
Figure 13C:
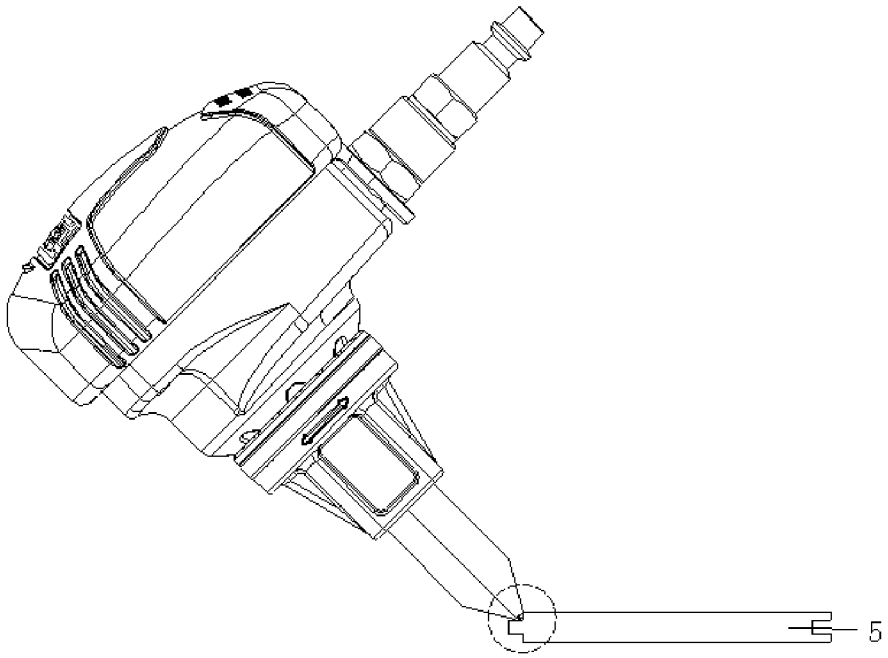
FIG. 13*c* is a diagram of a palm hammer positioned by the bumper in the invention.
Figure 13D:
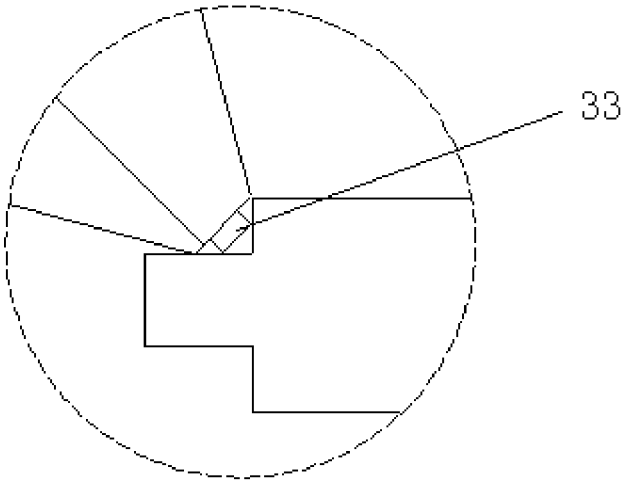
FIG. 13*d* is an enlarged diagram of part of FIG. 13*c*.
Figure 14A:
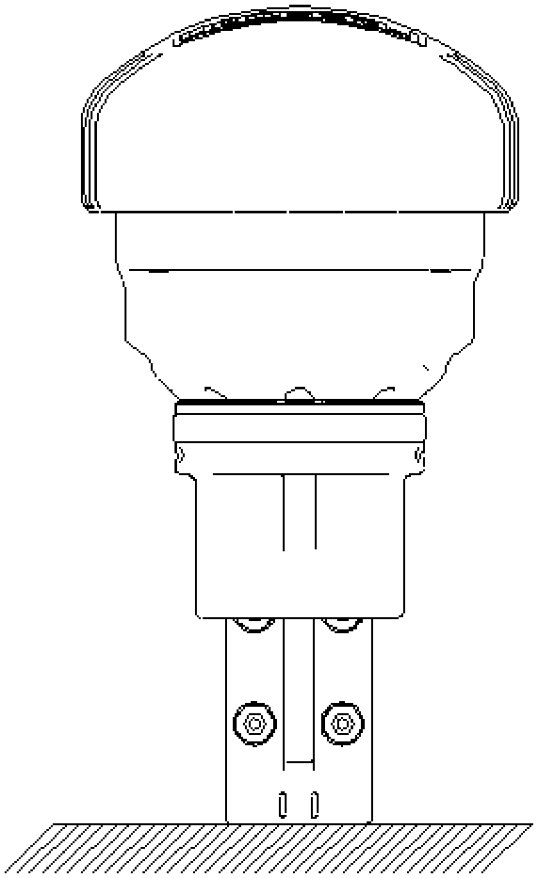
FIG. 14*a* is a perspective view of a palm hammer on the surface of a floor that is not protected with a bumper
Figure 14B:
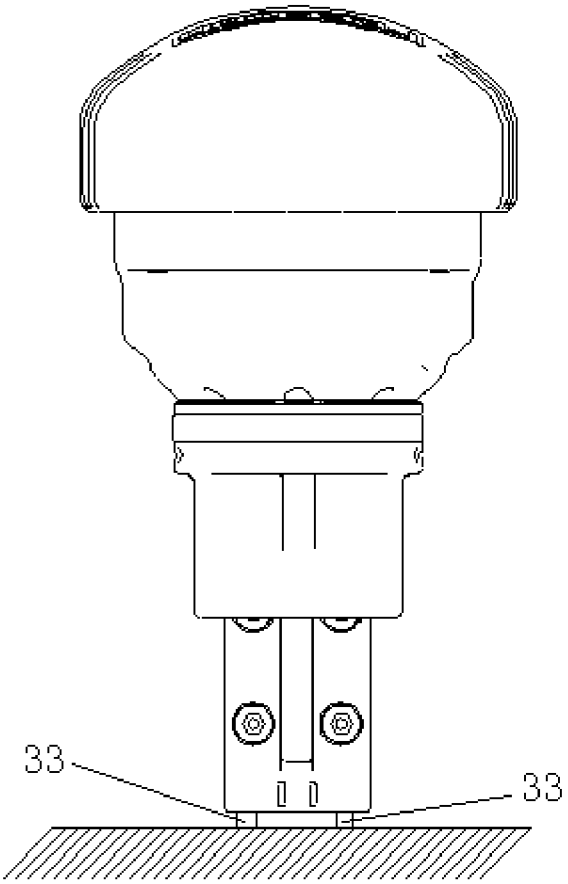
FIG. 14*b* is a perspective view of the invention on the surface of a floor that is protected with a bumper.

FIG. 8 is a cross-sectional diagram when a gas source is not connected. An upper aluminum cover 11, an air cylinder 12, a travelling valve 13, striker assembly 14, a cushion 15 and an inlet pipe 16 are arranged in the hammer body. The hammer body 1 encloses upper aluminum cover 11. The air cylinder 12 is affixed to upper aluminum cover 11. The travelling valve 13 is arranged between two upper sides of the striker assembly 14 and the low end of the air cylinder 12. In FIG. 9, after the inlet pipe 16 is connected with the gas source, the striker assembly slides downwards and reaches a limit place under the action of high-pressure gas. At this time, the upper and the lower spaces of the striker assembly are both under atmospheric pressure; therefore, the upper and the lower parts of the striker assembly are not stressed. However, high-pressure air surrounds the piston; therefore, when a tool is pressed downwards and to hit a nail, the striker assembly is propelled upwards through a counter-acting force. As shown by FIG. 10, under the action of the high-pressure air, the striker assembly slides upwards. As shown by FIG. 11, the compressed air facilitates the traveling valve to slide downwards while the striker assembly moves upwards. As the striker assembly comes into contact with the high-pressure air, it will return back to the state of FIG. 9 again, thus allowing the action to repeat.

The content, embodiments, and descriptions are merely a conceptual illustration of the possible realizations of such an invention. The protected scope of the invention shall not be limited to the detailed forms described in these embodiments. The protected scope of the invention is also based on the equal technical means thought by the persons skilled in the prior art in the field according to the invention.

What is claimed is:

1. A palm hammer, comprising: a bracket, a hammer body and a guide bushing, wherein a first cylinder end on the bracket and a second cylinder end on a hammer body are movably connected through a pin; the guide bushing is installed into the proximal of the bracket, a spring is fixed inside the bracket; one end of the spring contacts the hammer body, and another end of the spring contacts the guide bushing, the spring provides a reset force for an upward and downward movement of the guide bushing; the hammer body is connected with the bracket through the first cylinder end and facilitates the bracket to be sleeved at the bottom end of the hammer body, so that the hammer body is rotatable around the axis of the bracket to facilitate the user standing at different angles to use a tool conveniently; a slot with rectangular cross section and a positioning convex platform are arranged at the inside of the distal of the bracket, the guide bushing is rectangular cross section and accommodated in the slot with a rectangular cross section of the bracket, and the two structures with the rectangular cross section cooperate to prevent the guide bushing from individually being rotated; the guide bushing moves upwards and downwards along an axial line of the bracket, and is positioned by an axial guide groove of the outer surface of the guide bushing and the positioning convex platform in the inner part of the bracket; the guide bushing of the palm hammer comprises a prism-shaped muzzle cover and a muzzle, wherein the muzzle cover and the muzzle are connected through bolts and joined into a guide bushing body; the guide bushing body is axially movable in the bracket of the palm hammer; the guide bushing body has an distal which is far away from the bracket and proximal which is near the bracket; the parts of the muzzle cover and the muzzle near the distal gradually narrow into a chisel-shape; the top side of the proximal of the body is long and narrow plane; the proximal of the body of the guide bushing rests against the spring on the hammer body of the palm hammer; the lateral sides of the muzzle cover and the muzzle respectively have the axial guide groove, the positioning convex platform of the bracket is positioned into the guide groove, so as to guarantee that the body of the guide bushing axially moves in the bracket and does not break away from the bracket; a bore used for accommodating a nail and a driving rod is axially opened on the muzzle; the bore passes through the distal and proximal of the body of the guide bushing; a positioning groove is opened on the surface of the muzzle opposite to the muzzle cover; one end of a bumper is placed between the muzzle cover and the muzzle through the positioning groove, and another end of the bumper protrudes out of the distal of the body of the guide bushing; a convex block on the bumper is accommodated into the positioning groove, and the width of the bumper is smaller than that of the distal of the body of the guide bushing.

2. The palm hammer according to claim 1, wherein there are two bumpers.

3. The palm hammer according to claim 1, wherein the bumper is made of material including plastic.

* * * * *